United States Patent [19]

Noé

[11] 4,134,283

[45] Jan. 16, 1979

[54] STRIP-PROCESSING LINES WITH COLD-ROLLING STANDS

[75] Inventor: Oskar F. Noé, Mülheim (Ruhr), Fed. Rep. of Germany

[73] Assignee: BWG Bergwerk- und Walzwerk-Maschinenbau GmbH, Duisburg, Fed. Rep. of Germany

[21] Appl. No.: 769,266

[22] Filed: Feb. 11, 1977

[30] Foreign Application Priority Data

Feb. 13, 1976 [DE] Fed. Rep. of Germany ..... 2605723

[51] Int. Cl.[2] ..... B21B 37/00

[52] U.S. Cl. ..... 72/8; 72/17; 72/19; 72/20; 72/161; 72/205

[58] Field of Search ..... 72/8, 9, 11, 12, 17, 72/19, 20, 161, 205

[56] References Cited

U.S. PATENT DOCUMENTS

| | | | |
|---|---|---|---|
| 3,559,431 | 2/1971 | Noe et al. | 72/8 |
| 3,764,050 | 10/1973 | Clark | 226/25 |

*Primary Examiner*—Milton S. Mehr
*Attorney, Agent, or Firm*—Karl F. Ross

[57] ABSTRACT

A strip-processing line for the continuous after-rolling of metal strip between a pair of bridles. According to the invention the drive motors of the upper and lower cold-rolling rollers are hydraulically driven, the rollers are controlled by the speed of the strip in one phase of operation and by the pressure or force with which the rollers are urged against the strip in a second phase.

10 Claims, 2 Drawing Figures

STRIP-PROCESSING LINES WITH COLD-ROLLING STANDS

FIELD OF THE INVENTION

The present invention relates to an apparatus for the rolling of metal strip and, more particularly, to continuously operating strip-processing lines in which a cold after-rolling stand is provided between a pair of strip-engaging bridles between which the strip is under tension and which can include between them, a stretch-bending straightener for the strip.

BACKGROUND OF THE INVENTION

In the production of steel or other metal strip, it is a common practice to provide a continuously operable strip-processing line containing a cold after-rolling stand having a pair of rolls which engage the strip between them. After-rolling stands of this type are provided for various purposes and in various strip-processing lines. For example, they are known in zinc-coating, aluminizing and annealing lines to alter the crystallography of a strip or a coating thereon, to calibrate (i.e., adjust the thickness) the strip, or to effect some other type of surface conditioning.

The after-rolling stand is generally provided between a driving bridle and a retarding bridle, possibly in combination with a stretch-bending roller assembly constituting a strip straightener. Each such bridle, as is well known, may comprise at least one pair or rollers with the strip passing around the major part of the circumference of one roller and then around the major part of the circumference of the other roller so that the two rollers of the pair apply substantial frictional force to the strip.

The advantage of a strip-process line of the aforedescribed type is that a separate rolling process need not be carried out with storage of the strip after a previous rolling and before the after-rolling, special transport means for manipulating or handling the strip materials being thereby obviated.

With increasing frequency, such strip-processing lines are provided, at their discharge ends with table shears at which lengths of strip are severed. The after-rolling must be carried out previously in such cases. The after-rolling has as its principal purpose the modification of the surface structure of the band to achieve a desirable grain or crystal character or to modify the roughness properties.

When metal coatings are applied to the steel, the cold after-rolling may be used to break up an undesirable crystal structure or increase the fineness of the grain of the coating layer as noted. Cold after-rolling stands have not, as a rule, been operated at their full capacity (speed) in conventional strip-processing lines since an absolute agreement between the strip-velocity controllers for the remainder of the processing line and the cold after-rolling stand cannot be achieved in practice. As a result, the cold after-rolling stand is generally operated as an entrained unit, i.e., the rolls are dragged around by entrainment with the strip which is otherwise displaced, e.g., at the downstream bridle or thereafter. In this case, the rolls of the after-rolling stand do not have respective drive motors for the upper and lower rolls.

Customarily a continuously processed strip comprises lengths of the metal strip which are welded together in end-to-end relationship, the weld seams passing periodically or, more accurately, intermittently between the upper and lower rolls of the cold after-rolling stand. To prevent these weld seams from damaging the roll surfaces, it is common practice to provide means for spreading the rolls apart for the passage of each weld seam.

While this prevents damage to the rolls by the weld seams, it introduces another problem since at least the upper roll ceases to contact the strip and the peripheral speed of this upper roll may lag behind the surface speed of the strip (i.e., its linear velocity) so that, when the two rolls are again brought into forceful engagement with the strip for the after-rolling thereof, the surface of the upper roll upon contact with the strip may be at a lower velocity.

Since the strip moving at high speed and coming into contact with a lower speed rolling surface may be marred, it has already been proposed to accelerate a lagging roll of a cold after-rolling stand to a peripheral speed which is equal to the linear velocity or surface speed of the strip. Such systems have been applied to drag rolling stands of the type previously mentioned and are only effective when the rolls are spread away from the strip and must be controlled by hand.

When the resulting manual setting of the peripheral speeds of the upper and lower rolls is not precise, upon contact of the rolling surfaces with the strip, the resulting slippage will give rise to surface defects and even, in the case of thin sheet metal strip, to tearing thereof.

Another disadvantage resides in that a high rolling rate for the cold after-rolling stand having dragged or entrained upper and lower rolls, is that increasing rolling rates require increasing strip tension especially with thin strip, to which high rolling pressures are applied, the strip cross-section is not capable of withstanding the tension forces which must be applied for high rolling rates and the strips tear.

Difficulties are also encountered when the after-rolling stand is combined with a stretch-bending straightening device, i.e., a roller leveler, since the high tension forces may give rise to excessive stretching at the roller leveler. This cannot be reduced by reducing the degree to which the stretch-bending rollers project into the horizontal plane of the strip since this reduces the effectiveness of the leveler.

Moreover, with reduced bending stresses in the roller leveler, the internal stresses in the strip cannot be fully equalized and the desired planar anisotropy, shape-change characteristics, especially for low-carbon steel strip, cannot be obtained. Finally, in this connection, the desired degree of tension cannot be maintained at the stretch bending or roller leveler.

Accordingly it has been proposed to provide, separate from the cold after-rolling stand, special breaking and tensioning bridles and even to provide the roller leveler with separate strip-tensioning bridles so that the desired degree of tension can be maintained for a given strip-transport rate, the desired degree of penetration of the leveling rollers etc.

These expedients have been found to be very costly and, in some cases, unreliable.

OBJECTS OF THE INVENTION

It is the principal object of the present invention to provide an improved rolling apparatus, i.e., a strip-processing line with a cold after-rolling stand, in which the operation of the rolls can be controlled to accommodate high strip tension, high line speeds and high processing rates without damage to the rolls or the strip and without adversely affecting processing devices downstream of the cold-rolling stand, namely, roller levelers or the like.

Still another object of the invention is to provide an improved apparatus for the cold-rolling of previously rolled metal strip in which the strips are passed continuously between a pair of after-rolling rolls and are welded together in succession.

It is another object of the invention to provide an improved drive system for the rolls of a cold after-rolling mill for the continuous processing of strip metals.

I also have as my object, in this invention, to eliminate the disadvantages of earlier systems and provide an improved system for controlling the operation of a cold after-rolling mill for continuous metal strip.

SUMMARY OF THE INVENTION

These objects and others which will become apparent hereinafter are attained, in accordance with the present invention, with a cold after-rolling mill whose rolls are driven by respective motors and these motors are controlled selectively in response to velocity or in response to force via respective control circuits.

More particularly, the roll displaced away from the strip is driven at a peripheral speed controlled in dependence upon the surface speed of the strip and, after attaining the same surface speed as the strip and being brought back into pressure contact therewith (after permitting a weld seam to pass), the control of the speed of the rolls is switched over to a force, pressure or torque control.

Reference will be made herein to "moment" control of the drive motors of the after-rolling rolls and hence a brief clarification of what is intended by this term appears to be in order. When a rolling-mill roll is forced against a workpiece to be rolled, e.g., the strip, the force applied to the strip is a function of the pressure of the roller against the strip and the peripheral force which is applied to the roll by its drive means. This combination of forces can be considered a "moment" applied at the periphery of the roll. When the roll is driven at a substantially constant rate corresponding, for the most part, to the rate of advance of the strip, this "moment" is a function of the pressure with which the roll acts upon the strip and hence the pressure with which the roll is displaced toward the strip by the means provided for this purpose, e.g., hydraulic cylinders. The "moment" can thus be determined by measuring the pressure applied to the roll as it is urged against the strip and represents the three factors mentioned previously, namely, the "moment" of the periphery of the roll, the torque on the roll, and the force or pressure with which the roll is urged against the strip. Basically, therefore, the "moment" control is a force control of the rolling action.

The "moment" controller, according to the invention, regulates the drive of the rolls in a proportional dependency upon the instantaneous rolling pressure.

The invention is based upon the face that the upper roll and the lower roll of a cold after-rolling stand and the associated drive motors can fulfill different functions, on the one hand driving the upper roll and the lower roll when the latter are withdrawn from pressure engagement with the strip so as to accelerate them to the speed of the strip without requiring manual speed setting and, on the other hand, during the rolling operation, i.e., when the rolls are applied with pressure against the strip, operating the rolls with a force control ("moment" control) in dependence upon the instantaneous rolling pressure. The two-fold control operation thus permits a high rolling efficiency and rate to be obtained even with a cold after-rolling stand, prevents damage to the strip and prevents damage by the strip welds to the rolls.

It is of special significance that, as a result of the "moment" control of the drive motors, the speed of the latter and hence the peripheral speeds of the rolls can be coordinated with the strip speed and the operating speed of the strip processing line. To the extent that the drive force for the strip is not supplied by the drive motors, it can be contributed by the application of tension to the strip, e.g., by additionally drawing it through the stand via conventional means. The need for such additional means is, however, relatively minor so that the cold-rolling can be effected with minimum strip tension and hence minimum tension stress in the strip.

According to a particular feature of the invention, the drive motors are hydraulic motors and are connected in a hydraulic circuit with one or more pumps, advantageously including control valves or the like responsive to digital or analog speed sensors or pressure sensors. The electrical circuit means of the sensors can include operational amplifiers and flow controllers for voltage or current control of the motor speed. The "moment" controller can respond to the pressure of the rolling cylinders and can likewise be provided with digital or analog pressure sensors, with or without respective operational amplifiers for voltage or current control pressure regulators.

The digital or analog velocity sensors can measure the peripheral speed of the upper roll, the lower roll and the strip via speed-measuring wheels or other velocity detectors. Advantageously, the hydraulic circuit of the pump includes two electromagnetically operable multi-position valves for switching over the system from voltage or velocity control to pressure or "moment" control. According to the invention, the hydraulic motors can contribute, during "moment" control, up to 90% of the driving force required for the rolls and the strip while the remainder (at least 10%) is contributed by strip tension applied downstream of the after-rolling stand.

The advantages of the system of the present invention are to be found in the possibility of providing a continuously operating strip-processing line with a cold after-rolling stand and, if desired, with an associated roller-straightening device such that the cold-rolling stand, their upper and lower rolls have speeds matched to the strip speed or the processing line speed, but during the rolling operation only a "moment" control of the associated drive motors is effected.

This "moment" control is primarily dependent upon the rolling capacity (rate at which the strip thickness is reduced) and not from the strip speed so that the rolls can have an appropriate peripheral speed during the rolling operation.

However, when the upper roller is lifted from the strip and the lower roll engages the latter only with slight contact or pressure, the peripheral speeds of both must be brought to the same value as the linear speed of the strip so that, as the rolls are brought to bear forcibly against the strip, the danger of tearing the latter or other damage is avoided.

Finally, the system is advantageous because of the manner in which it can be used with associated devices, especially stretch-bending or roller-straightening arrangements because the latter can be operated with low or minimal strip tension. Low stretch tensions mean that severe distortions in the stretch-bending arrangements can be eliminated while the desired degree of stretch is maintained. The bending component can be high and thus undesired strip contractions are eliminated. Especially uniform stress distributions are obtained and the desired positive influence on the planar anisotropy and form-change characteristics and aging characteristics, especially for low-carbon steel strip, are achieved. Furthermore, the tension required for the stretch-bending straightener can be produced by the after-rolling stand.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
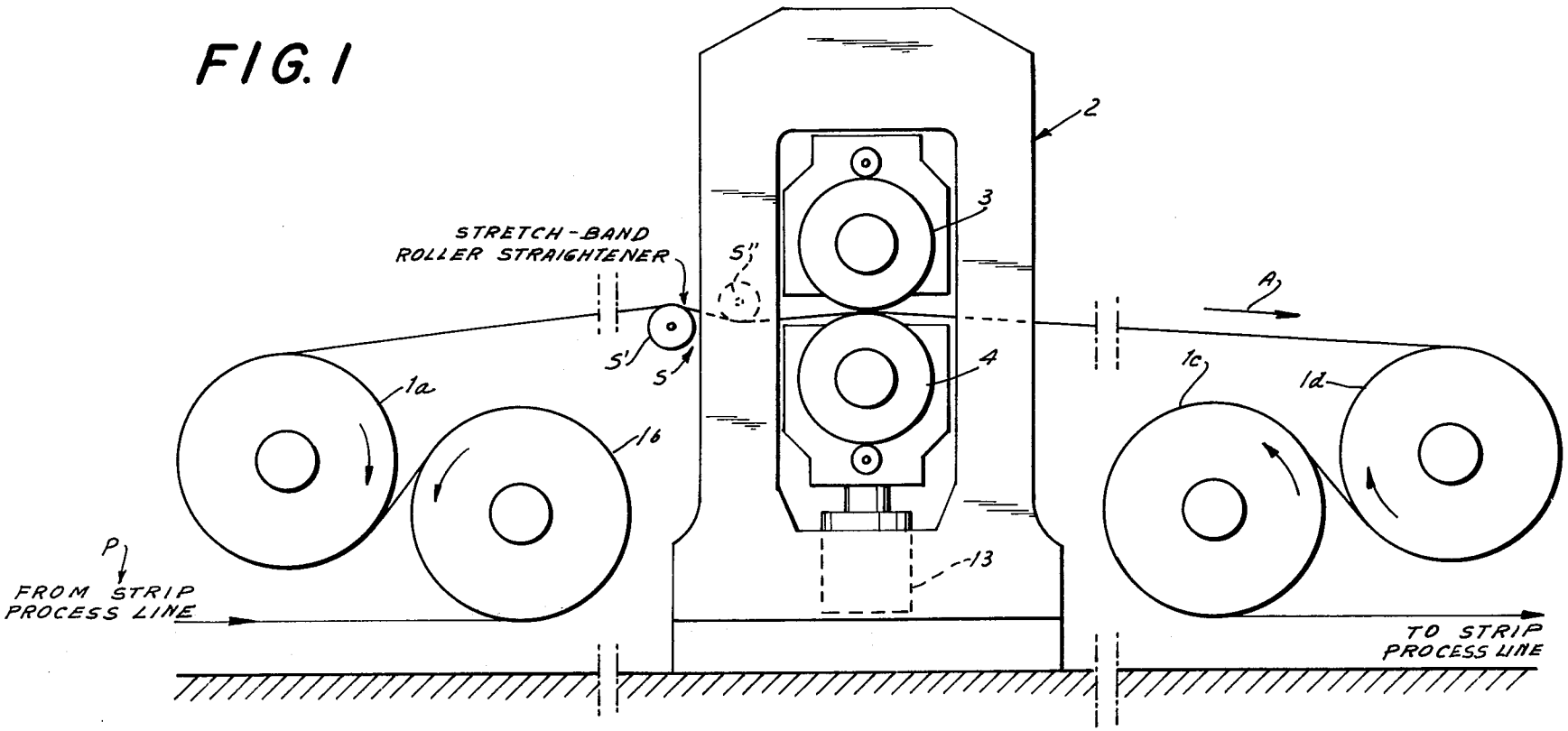
FIG. 1 is a diagrammatic elevational view illustrating a cold-rolling stand forming part of a strip-processing line according to the invention.

In FIG. 1 of the drawing, I have shown somewhat diagrammatically a cold after-rolling stand 2 having an upper cold-rolling roll 3, a lower cold-rolling roll 4 and a hydraulic cylinder arrangement 13 adapted to press the lower roll 4 against a strip 6, e.g., low-carbon steel, with the rolling pressure and further provided with means, not shown in detail, for dropping the lower roll 4 and thereby permitting the strip to pass between the rolls without forcible engagement, e.g., when a seam between lengths of the continuous strip is to traverse the stand 2.

The after-rolling stand 2 is provided in a process line generally represented in P, e.g., a zinc-plating line, between a pair of bridles 1 each of which comprises a pair of rollers 1*a*, 1*b*, 1*c* and 1*d* about which the strip passes through an arc in excess of 180°. The bridle rollers rotate in opposite senses as has been illustrated by respective arrows.

Furthermore, the strip-process line can include a stretch-bending roller straightener generally designated at S and two rollers s' and s'' of which have been shown. While the cold-rolling stand 2 is of the twin roll type, so-called quadruple roll arrangements of other conventional rolling stand configurations can be used (see THE MAKING, SHAPING AND TREATING OF STEEL, U.S. Steel Co., Pittsburgh, Pa., 1971).

Figure 2:
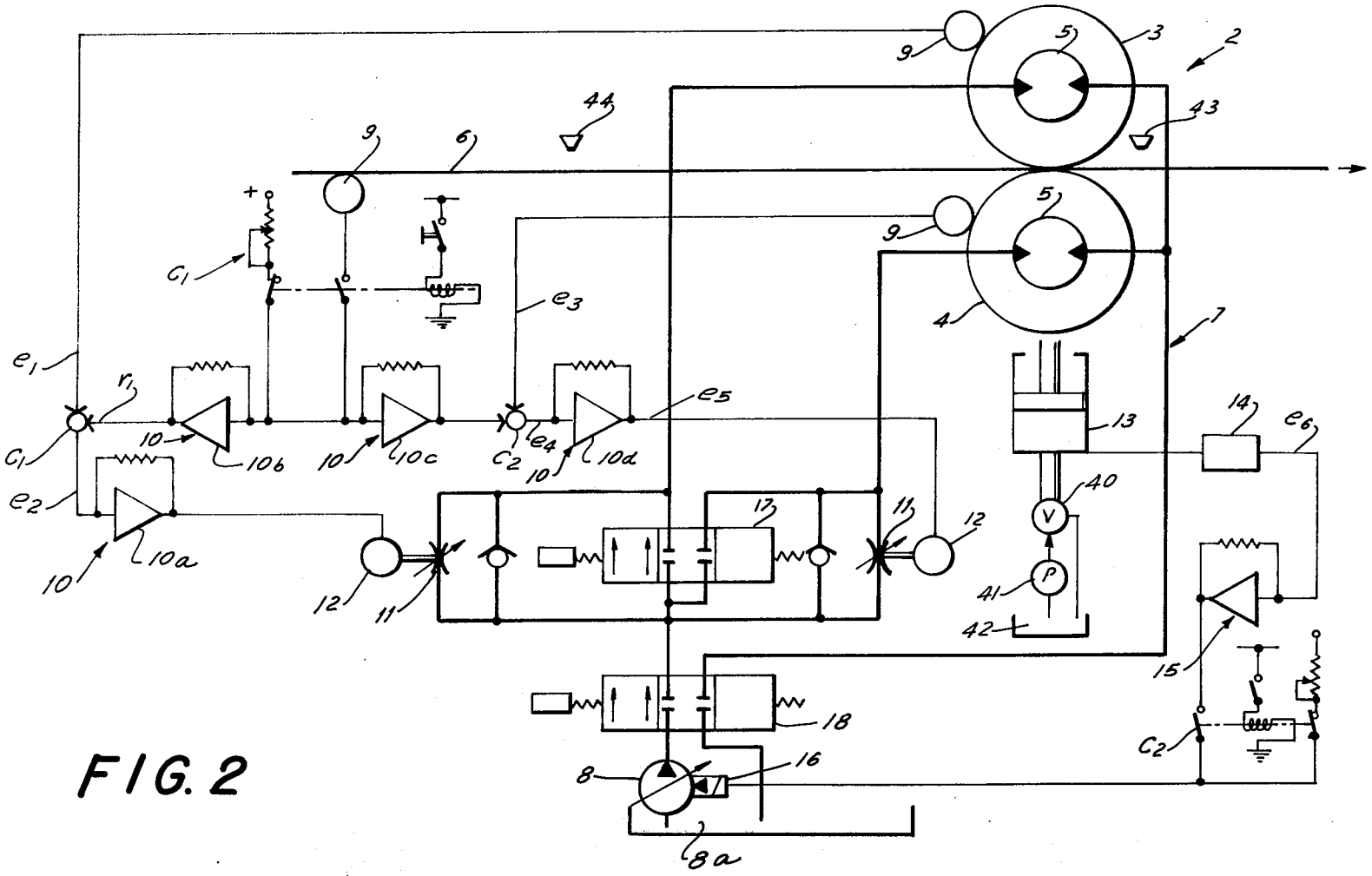
FIG. 2 is a hydraulic circuit showing various control elements for the stand of FIG. 1, according to the invention.

As can be seen from FIG. 2, each of the rolls 3 and 4 of the cold rolling stand 2 is driven by a respective drive motor 5 of the hydraulic type (see FLUID POWER, U.S. Government Printing Office, 1966) operated by hydraulic fluid supplied by a pump 8 from a reservoir 8*a*. The pump 8 can be the variable-displacement type (FLUID POWER, pages 109–122) and can have a control member 16 for varying the output per revolution of the pump.

The drive motor 5 can be selectively operated in response to a speed controller or a moment controller, each of which includes a respective circuit. Basically, the speed controller circuit comprises means responsive to the peripheral speeds of the respective rolls and means responsive to the linear speed of the strip 6, these speeds being compared and the comparison signal utilized to control the speeds with which the motors 5 are driven and hence to determine the peripheral speed of each roll. When the peripheral speed reaches the linear speed of the strip and the rolls are applied forcibly against the strip by the cylinder 13, the circuitry switches over and a moment control of the speed in response to the applied rolling pressure. The motors 5 and their hydraulic supply are provided so that 90% of force required to displace the strip through the cold rolling stand and to effect the cold rolling is supplied by the motors 5, the remaining 10% being covered by band tension as applied in the direction of arrow A at a point downstream of the apparatus shown in FIG. 1 along the strip processing line.

The hydraulic circuit 7 comprises, in addition to the pump 8, a digital or analog speed control arrangement which includes speed sensors 9, operational amplifiers 10 and flow controllers 11 with current or voltage operation as represented at 12. In addition, the cylinder 13 has a digital or analog pressure sensor 14, an operational amplifier 15 and a voltage of the current responsive pressure controller 16 for moment control.

Hydraulic motors have been found to be especially desirable and can be connected directly to the rolls, i.e., without intervening transmissions or can be brought directly into them. The digital or analog speed sensors 9 respond to the peripheral speed of the upper roll and the lower roll and to the linear speed of the strip 6 by respective measuring wheels.

The hydraulic circuit 7 also includes two electromagnetically actuatable multi-path valves 18 and 17 to switch over from quantity or speed control to pressure moment control. Thus either the control circuit for speed control or the control circuit for moment control is operated at any time.

The wheel of the direct current rate generator 9 engaging the upper roll 3 (SERVOMECHANISM PRACTICE, McGraw-Hill Book Co., New York, 1960, pages 327 to 331) producing an analog signal $e_1$ which is proportional to the peripheral speed of roll 3 and is applied to a comparator $c_1$ which acts as an error detector (pages 4 ff. of SERVOMECHANISM PRACTIVE) whose error signal or actuating signal e, is applied to the operational amplifier 10*a* controlling the actuator 12 of throttle 11.

The reference input $r_1$ to this error detector is delivered through the operational amplifier 10*b* from the rate generator 9 responsive to the linear speed of the strip 6. The same rate generator, via the operational amplifier 10*c* applies a second reference signal $12_2$ to the error detector $c_2$ whose feedback signal $e_2$ is supplied by the rate generator responsive to the peripheral speed of the lower roll 4. The output $e_4$ of the error detector $c_2$ is amplified in the operational amplifier 10*d* and is applied as a control signal $e_5$ to the actuator 12 which operates the other throttle 11. Each throttle 11 is connected between the output side of the pump 8, when the valve 18 is in its other position from the one illustrated in FIG. 2 and the valve 17 is in the blocking position which has been illustrated.

In this case, the operating rates of the two motors 5 is determined only by the cross section of the respective throttles and the rolls are brought to a peripheral speed independently, equal however to the linear speed 6. Circuit means $c_1$ can be provided to disconnect the detector 9 responsive to the linear speed and to operate a switch $c_2$ to render the moment control effective. Upon operation of switch $c_2$, the valve 17 is switched over to its lefthand position and valve 18 is switched into the position shown in the drawing. This circuitry is effective when valve 40 supplies fluid from the pump 41 and the reservoir 42 to the cylinder 43 sufficient to bring the rolls into forcible contact with the strip 6, the valve 40 responding to the simultaneous absence of the error signals $e_2$ and $e_4$ and a detector 43 which responds to the passage of a welded seam.

Since the valve 17 now bypasses the throttles 11 and the reference signals $r_1$ and $r_2$ are no longer delivered at the speed controller is no longer effective and the system responds to the output of the pressure transducer 14 which delivers a signal $e_6$ through the operational amplifier 15 to the actuator 16 to vary the delivery of the pump 8. A detector 44 can be provided to respond to an oncoming welded seam and reverse the switches and the valve to reestablish speed control when the pressure is relieved in cylinder 13 and the gap between the rolls is widened to pass the seam.

I claim:

1. A cold after-rolling apparatus for a strip-process line, comprising:

a rolling stand having an upper and a lower roll traversed by a strip;

respective motors connected to said rolls for driving same;

pressure means for pressing said rolls against said strip and relieving the pressure of said rolls against said strip;

means for energizing said motors, thereby driving said rolls;

first control means responsive to the peripheral speeds of said rolls and the linear speed of said strip for controlling said motors to cause said rolls to accelerate to peripheral speeds equal to the linear speed of said strip; and second control means for thereafter controlling said motors in a moment control thereof while said rolls bear against said strip.

2. The apparatus defined in claim 1 wherein said second control means includes means responsive to said pressure means for controlling the rolling moment in proportion to the pressure with which said rolls engage said strip.

3. The apparatus defined in claim 2 wherein said motors are hydraulic motors, said energizing means is a hydraulic circuit provided witn a pump for supplying said hydraulic motors and said first control means includes respective speed sensors and flow control operated in response to said speed sensors between said pump and motors.

4. The apparatus defined in claim 3 wherein said second control means includes a pressure sensor and means responsive to said pressure sensor and varying the displacement of said pump.

5. The apparatus defined in claim 4 wherein said speed sensors have respective measuring wheels engaging the peripheries of said rolls and said strip.

6. The apparatus defined in claim 4 wherein said hydraulic circuit includes a pair of electronically actuatable multi-path valves between said pump and said hydraulic motors for switching over the control of said hydraulic motors from said first control means to said second control means and vice versa.

7. The apparatus defined in claim 4 wherein said hydraulic motors during moment control supply up to 90% of the force required to displace said strip through stand.

8. The apparatus defined in claim 1 wherein said first and second control means include analog electronic elements.

9. The apparatus defined in claim 8 wherein said electronic elements are operational amplifiers.

10. The apparatus defined in claim 1 wherein said first and second control means include digital electronic elements.

* * * * *